US008397593B2

(12) United States Patent
Petrek et al.

(10) Patent No.: US 8,397,593 B2
(45) Date of Patent: Mar. 19, 2013

(54) QUICK-SET PIPETTE WITH DAMPED PLUNGER

(75) Inventors: James S. Petrek, Danville, CA (US); Michael C. Schmittdiel, Oakland, CA (US); William D. Homberg, Oakland, CA (US)

(73) Assignee: Rainin Instrument, LLC, Oakland, CA (US)

( * ) Notice: Subject to any disclaimer, the term of this patent is extended or adjusted under 35 U.S.C. 154(b) by 533 days.

(21) Appl. No.: 12/540,750

(22) Filed: Aug. 13, 2009

(65) Prior Publication Data

US 2011/0036185 A1 Feb. 17, 2011

(51) Int. Cl.
*B01L 3/02* (2006.01)

(52) U.S. Cl. ..... 73/864.18

(58) Field of Classification Search ..... None
See application file for complete search history.

(56) References Cited

U.S. PATENT DOCUMENTS 3,665,980 A * 5/1972 Croslin et al. ..... 141/183
4,929,428 A * 5/1990 Tezuka ..... 73/864.13
5,364,596 A * 11/1994 Magnussen et al. ..... 73/864.15
6,428,750 B1 * 8/2002 Rainin et al. ..... 73/864.01
7,175,813 B2 2/2007 Petrek et al.

* cited by examiner

*Primary Examiner* — Peter Macchiarolo
*Assistant Examiner* — Alex Devito
(74) *Attorney, Agent, or Firm* — Clarke A. Wixon

(57) ABSTRACT

A volume adjustable pipette, comprising a plunger mounted for movement in a housing to and from a stop to aspirate a fluid into and dispense the fluid from a tip extending from the housing. The movement of the plunger is damped to reduce sudden plunger movements. An axially moveable volume setting member in the housing defines the stop and a volume setting for the pipette and is axially moveable by a user turnable volume setting member. Turning of the volume adjusting member also controls a coarse volume setting means and a fine volume setting means, the course volume setting means being responsive to a relatively small turning of the volume adjusting member for moving the volume setting member a relatively large axial distance and the fine volume setting means being responsive to a relatively large turning of the volume adjusting member for moving the volume setting member a relatively small axial distance.

15 Claims, 8 Drawing Sheets

QUICK-SET PIPETTE WITH DAMPED PLUNGER

BACKGROUND OF THE INVENTION

The present invention relates to volume adjustable manual pipettes and, more particularly, to a manually-operated pipette equipped with a quickly settable volume adjustment mechanism and a plunger having damped axial movement.

U.S. Pat. No. 3,827,305 ("the '305 patent") describes one of the earliest commercially available digitally adjustable air displacement pipettes. To provide for volume adjustment, the pipette includes a threaded shaft extending through a fixed nut. Manual turning of the shaft produces axial movement of a stop member for limiting axial movement of a plunger to define a volume setting for the pipette. The volume setting is displayed on a mechanical micrometer display comprising a series of indicator rings each encircling the threaded shaft.

U.S. Pat. No. 4,909,991 describes a later commercially available single channel manual pipette manufactured by Nichiryo Co. Ltd., Tokyo, Japan. The Nichiryo pipette includes an elongated hand-holdable housing for an upwardly spring biased plunger. An upper end of the plunger extends above a top of the housing and carries a control knob for thumb and finger engagement in manually turning the plunger and for axially moving the plunger in the pipette housing between an upper stop and a lower stop at which all liquid within a tip secured to a lower end of the housing is expelled by the downward movement of the plunger. The upper stop is axially adjustable within the housing in response to a turning of a hollow volume adjustment screw or shaft keyed to the plunger. The axial adjustment of the upper stop adjusts the volume of liquid that the pipette is capable of drawing into the tip in response to upward movement of the plunger to the upper stop. The pipette also includes a lock mechanism including a lock knob for locking the plunger against rotation to thereby set the upper stop in a fixed position and hence set the volume adjustment for the pipette.

For a more complete understanding of the current state of the art relative to the volume adjustability of manual pipettes, each of the above-identified patents is incorporated by reference into this application.

In each of the foregoing prior manual pipettes, volume setting requires the repeated turning of either the threaded volume setting shaft or the turning of the displacement plunger of the pipette while viewing the volume display of the pipette. Where successive volume setting for a pipette are of values of considerable difference, appreciable time and physical effort are required to accomplish the volume settings.

Thus, one of the shortcomings of prior manual pipettes is the time, physical effort and care required to accurately manually set the volume of such pipettes. In an attempt to reduce the time required to change the volume settings of a manual pipette, the Socorex Micropipette Calibra 822 includes a volume setting mechanism including two cylindrical cams. A larger one of the cams shows numbers on a left side of a window of a mechanical volume display for the pipette while a smaller one of the cams shows numbers on a right side of the window. After locking of a plunger-button of the pipette, a turning of a setting wheel turns the larger cam to change the numbers displayed thereby. Then a pulling out of the setting wheel followed by a turning thereof produces a turning of the smaller cam and numbers displayed thereby. Such turning of the cams sets mechanical stops within the pipette to control the volume of liquid, which the pipette will aspirate and dispense. While the volume setting structure of the Calibra pipette may reduce the time required to set the volume of a manual pipette, the volume setting structure is relatively complex and costly when compared to conventional manual pipette volume setting mechanisms as described above. Also, the volume setting provided by the Calibra pipette is not as fine a setting as is provided by conventional volume setting mechanisms.

U.S. Pat. No. 6,428,750 issued Aug. 6, 2002 to the assignee of the present invention ("the '750 patent"), and U.S. Pat. No. 7,175,813 issued Feb. 13, 2007 also to the assignee of the present invention ("the '813 patent"), describe an improved volume adjustable manual pipette having a quick set volume adjustment mechanism and a plunger position sensor. The volume setting of the pipette is monitored by the sensing and control circuitry to provide a real time display of the volume setting of the pipette on the electronic digital display.

In particular, the '813 patent describes a manual handheld pipette capable of being adjusted with both coarse and fine volume setting capabilities, capable of being adjusted by sequentially turning a single volume adjustment member. This pipette has been found to be particularly easy and intuitive to use, as no tools are necessary to make coarse or fine volume adjustments, and only a single control need be handled, as in traditionally adjustable pipettes.

The quick set feature in the '750 and '813 patents referenced above represents a considerable advance in the art of manual pipettes. However, it has been found that when volume settings are advantageously adjusted with small and relatively easy movements, the stability of the volume setting becomes less resistant to drift and more susceptible to bumps and accidental movements.

There is a continuing need for a volume adjustable manually operated pipette including a quickly and easily adjustable volume setting mechanism that remains stable when perturbed. A pipette with a reliable mechanism capable of changing the volume setting relatively rapidly and without unnecessary manipulation would enable enhanced functionality over traditional manually operated pipettes.

SUMMARY OF THE INVENTION

Accordingly, a manually operated pipette according to the invention addresses the shortcomings of presently commercially available handheld pipettes, and adds additional functionality not practicable using traditional manual pipettes.

Manual pipettes have continued to be popular systems of choice due to their lower cost and ultimate control that the user has in choosing how to manually push the plunger down. Traditional manual pipettes, however, can be tedious to adjust, requiring up to twenty turns (and typically eighteen turns) of the wrist from minimum to maximum volume, or vice versa. The pipette according to the invention requires as little as two and one half turns in one embodiment to adjust the volume setting the same amount, and such a pipette can be set just as accurately and precisely as traditional manual pipettes.

The volume adjustable pipette of the present invention comprises a plunger mounted for movement in a housing to and from a stop to aspirate a fluid into and dispense the fluid from a tip extending from the housing. An axially moveable volume setting member in the housing defines the stop and a volume setting for the pipette and is axially moveable by a user turnable volume adjusting member. Turning of the volume adjusting member also controls a coarse volume setting means and a fine volume setting means. The coarse volume setting means is responsive to a relatively small turning of the volume adjusting member for moving the volume setting member a relatively large axial distance while the fine volume setting means is responsive to a relatively large turning of the volume adjusting member for moving the volume setting member a relatively small axial distance. Thus, the present invention provides a rapid setting of the volume of a pipette simply by sequential turning of a volume adjusting member.

In a pipette according to the present invention, the movement of the plunger is damped to reduce the occurrence of sudden, abrupt changes in the piston position driven primarily by the spring-biased piston being accidentally released by the user, for example when the user's thumb is quickly removed from the plunger button while the plunger button is depressed. The plunger mechanism may then impact the volume setting mechanism, overcoming a user-actuated frictional lock intended to keep the volume setting in place. The damped plunger reduces the tendency of the volume setting mechanism to drift under such adverse (but occasionally expected) circumstances.

One embodiment of a pipette according to the present invention is provided with a real-time electronic sensor, a low-power microcontroller, and a simple yet flexible user interface. The electronic sensor permits the position of a piston to be sensed and communicated to the user in real time via a user interface, and for the volume setting of the pipette to be read reliably without any dependence on a mechanical link between the interface and the coarse and fine volume setting means.

In an embodiment of the invention, a processor integral with the pipette not only allows the volume setting and the real-time piston position to be communicated to the user via a display, it further allows various calculations to be performed on the piston position, including the advantageous use, communication, and manipulation of liquid volume measurements, pipetting technique analysis, use observation and auditing consistent with preferred laboratory practices, performance optimization, calibration offsets, multi-point non-linear calibration, and cycle counting, as set forth in U.S. patent application Ser. No. 11/906,180, filed on Sep. 27, 2007 and published on Jan. 1, 2009 as Publication No. 2009/0000351, which is hereby incorporated by reference as though set forth in full herein.

As described herein, the invention is particularly applicable to air-displacement pipettes, though it should be noted that the structures and functions described herein are also applicable to positive-displacement pipettes.

BRIEF DESCRIPTION OF THE DRAWINGS

These and other objects, features, and advantages of the invention will become apparent from the detailed description below and the accompanying drawings, in which.

DETAILED DESCRIPTION OF THE INVENTION

The invention is described below, with reference to detailed illustrative embodiments. It will be apparent that a system according to the invention may be embodied in a wide variety of forms. Consequently, the specific structural and functional details disclosed herein are representative and do not limit the scope of the invention.

Figure 1:
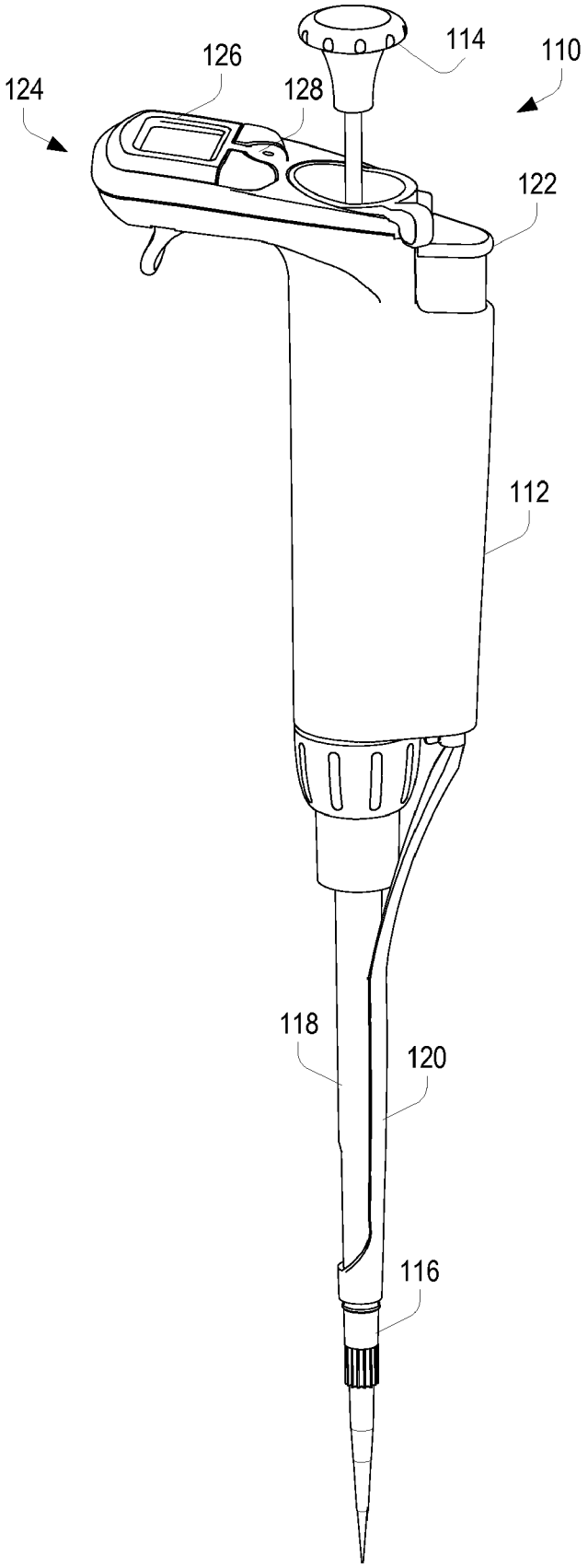
FIG. 1 is an external view of a quick-set pipette according to the invention, with a disposable tip mounted to a liquid end of the pipette.

Referring initially to FIG. 1, an overview illustration of a handheld quick-set pipette 110 according to the invention is presented. In general configuration, the quick-set pipette 110 is similar to a traditional pipette, in that a user grips a handheld body 11 2 of the pipette 110 and manipulates a spring-loaded plunger button 114 to control the intake and discharge of fluids through a disposable tip 116, which is coupled to a liquid end 118 of the pipette 110.

Figure 4:
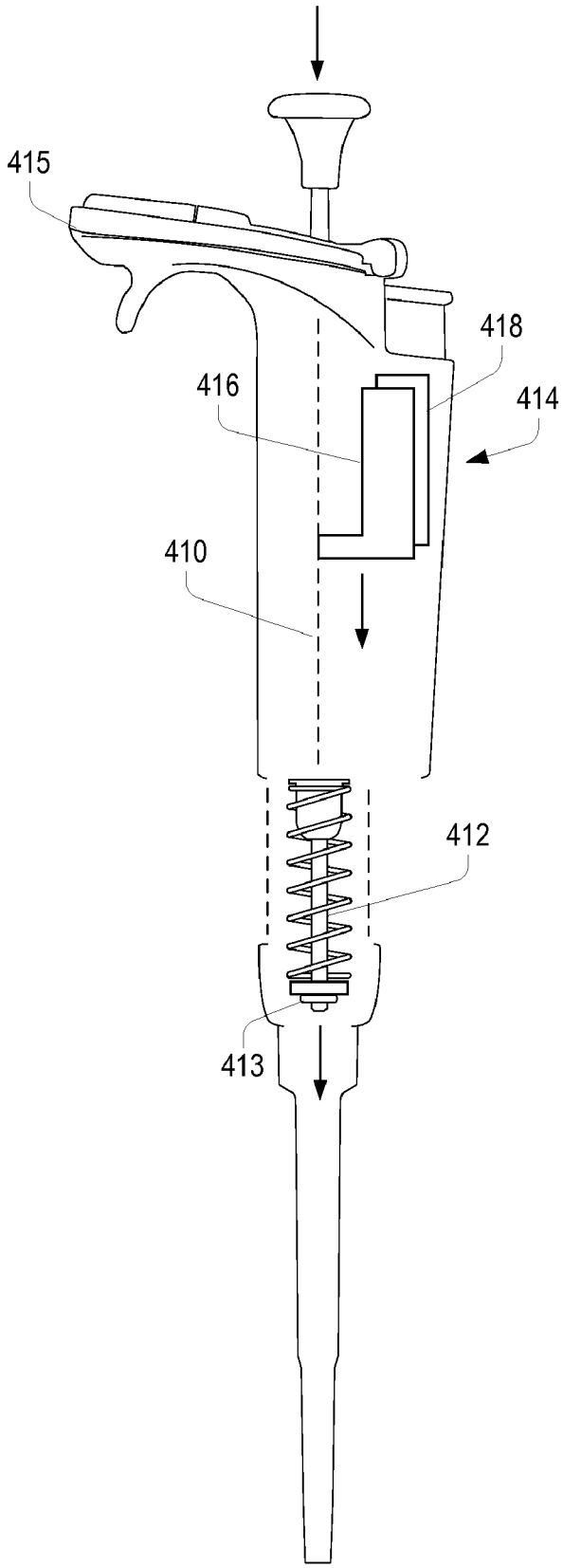
FIG. 4 is a schematic view illustrating a rigid linkage between a plunger assembly and a sensor assembly of the pipette of FIG. 3.

As in traditional air displacement pipettes, the plunger button 114 operates a piston configured to displace air within the liquid end 118; movement of air causes a corresponding movement of a liquid, provided an air-tight seal is present between the tip 116 and the liquid being handled, between the tip 116 and the liquid end 118, and between the piston and a seal (as illustrated in FIG. 4 and described below).

The quick-set pipette 110 further includes a tip ejector 120 mounted for longitudinal movement over the liquid end 118 and coupled to a tip ejector button 122. After the tip 116 is mounted to the pipette 110 and used, it can be ejected and disposed of by depressing the ejector button 122; this functionality is again comparable to the functionality of traditional pipettes.

Where the disclosed embodiment of the quick-set pipette 110 begins to differ from traditional handheld pipettes, however, is in the presence of a user interface 124 including an electronic display 126 and button panel 128. In the pipette 110 according to the invention, the display 126 and button panel 128 add very little weight to the pipette, are easily operated, and enable improved performance and added functionality to the pipette 110 that are not generally practical with traditional pipettes. These differences will be discussed in further detail below. It should be noted, however, that an alternative embodiment of a quick-set pipette according to the invention may be made as described herein without any electronic features whatsoever, and accordingly no electronic display 126 and no button panel 128. The utility of such an alternative embodiment may well be limited, however, as there would be no electronic display to indicate the volume setting for the pipette, and a mechanical volume counter (such as found in traditional handheld pipettes) would be difficult to implement.

Figure 2:
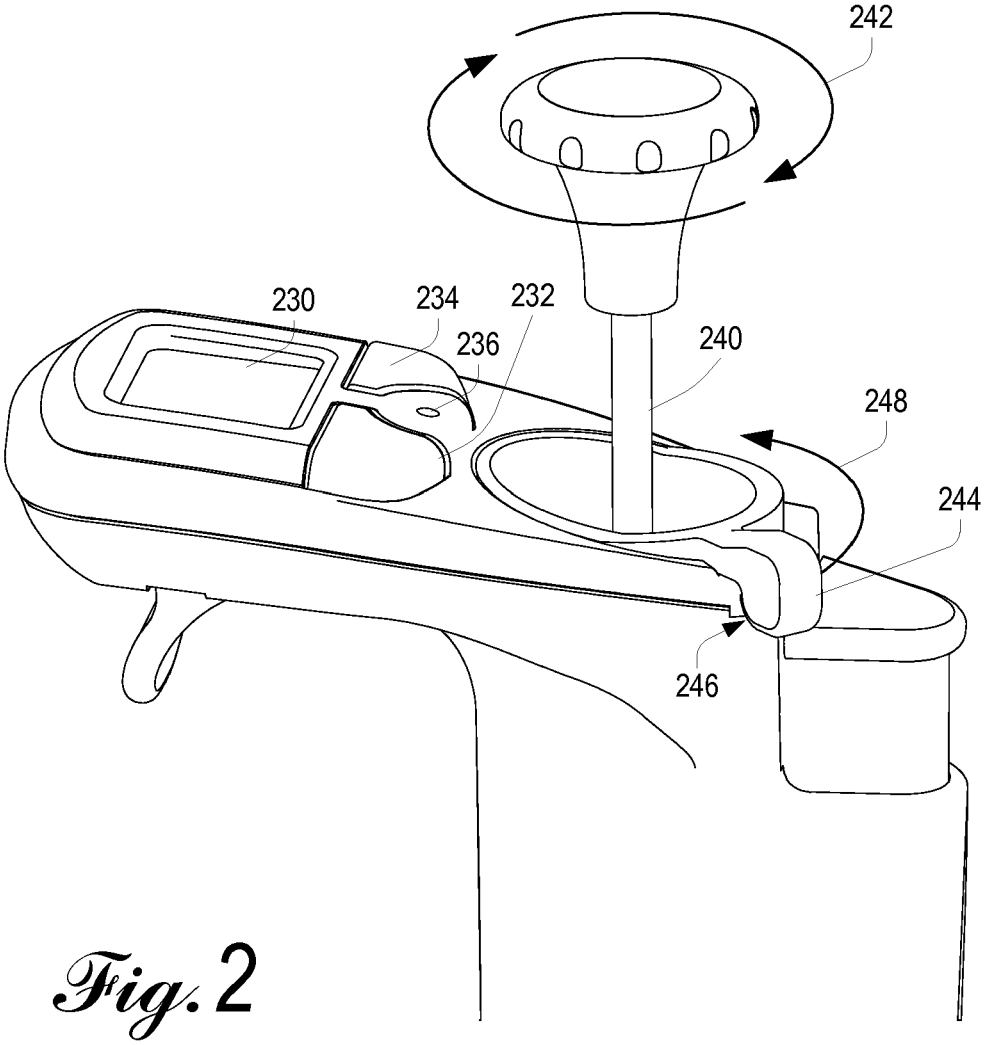
FIG. 2 is an enlarged external view of the quick-set pipette of FIG. 1, illustrating the functionality of a volume-setting mechanism according to the invention.

As shown in FIG. 2, the disclosed user interface 124 is designed and configured to be intuitive and easy to use. In the disclosed embodiment, the display 126 is a small LCD 230, and the button panel includes a "MODE" button 232, a "CC" (cycle count) button 234, and a recessed "OPTION" button 236 accessible via a small opening 238. As will be discussed in further detail below, the MODE button 232 is generally used to scroll through pipette operating modes and CC button 234 operates the cycle counter. The recessed OPTION button 236 is generally used to access an options menu, which gives access to advanced features and capabilities of the quick-set pipette 110.

The user interface further includes a piston plunger shaft 240 upon which the plunger button 114 is mounted, which also serves as a volume-setting knob when rotated as indicated by the arrows 242 and a volume set lock lever 244. The volume set lock lever is movable from a left-most unlocked position 246 and a right-most locked position as indicated by an arrow 248. In the left-most unlocked position 246, the plunger button is free to rotate and change the volume of the pipette 110, as in traditional pipettes, while in the right-most locked position (arrow 248) the plunger button is restricted from rotational motion (hence fixing the volume) but still permitted to be pushed by the user's thumb to control the intake and discharge of liquids as desired by the user. The design and operation of the locking apparatus is set forth in U.S. Pat. No. 5,849,248, owned by the assignee of the present invention, which is hereby incorporated by reference as though set forth in full. Mechanisms of this sort are commonly known.

Figure 3:
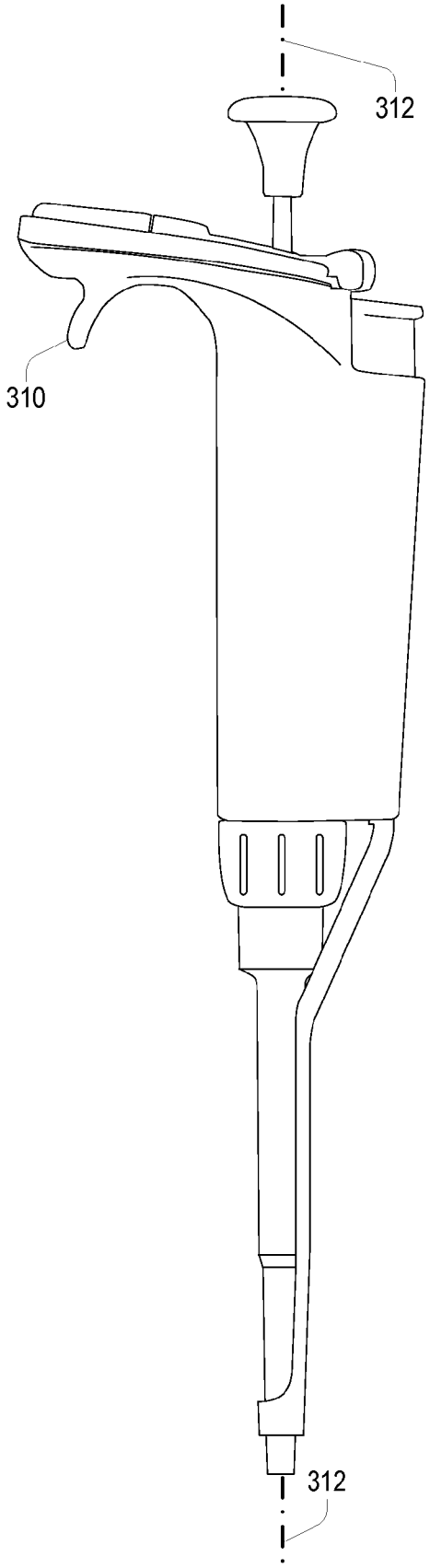
FIG. 3 is a simplified external view of the quick-set pipette of FIG. 1.

As is visible in the simplified drawing of FIG. 3, a finger hook 310 is further provided to allow the user to maintain a light grip on the body 112. The plunger button 114, the plunger button shaft 240, the pipette body 112, and the liquid end 118 are all coaxial with respect to a centerline 312, thereby permitting a single linkage 410 (FIG. 4) between the plunger button and the operative portion of the pipette 110 in the liquid end 118 that operates without substantial slack or backlash. And, because the mass of the pipette 110 is centered around the centerline 312, and the display 126 and button panel 128 above the finger hook 310 contain very little mass, the quick-set pipette 110 according to the invention remains as easy to handle as a traditional pipette.

The linkage 410, as illustrated functionally in FIG. 4, enables the plunger button 114 to act directly through the plunger button shaft 240 to a piston 412, which maintains an air-tight seal with the liquid end 118 via a seal 413. The seal 413 remains in a fixed position with respect to the liquid end 118 and further forms an air-tight seal with respect to an interior portion of the liquid end 118. Accordingly, as the plunger button 114 is manipulated, the piston 412 is caused to move through the seal 413 and displace an air volume within the liquid end. As an orifice 150 (FIG. 1) is provided at a distal end of the tip 116, and a substantially air-tight seal is maintained at all other places, the only path for a liquid (or any fluid) to enter or exit the tip 116 is via the orifice 150, and there is a deterministic relationship between the volume of air displaced by the piston 412 and the volume of liquid manipulated by the pipette 110. As will be discussed in further detail below, this relationship between air displacement and liquid manipulation is generally linear but subject to some correction. Traditional handheld manual pipettes treat the relationship as exactly linear with a correctable zero offset.

The coaxial linkage 410 and connection between the plunger button 114 and the piston 412 enables a position sensing transducer 414 to be connected thereto, allowing the precise and specific position of the plunger button 114 (and hence the tightly coupled piston 412) to be determined at all times. The position sensing transducer 414 is small in size and requires very little battery power to operate. Accordingly, a handheld quick-set pipette 110 according to the invention has a comparable feel to traditional manual pipettes, and any battery used to power the position sensing transducer 414 and the display 126 can be quite small. In the disclosed embodiment, a protruding portion 415 of the pipette body 112 (FIG. 1) between the display 126 and the finger hook 310 (FIG. 3) houses a primary (i.e. non-rechargeable) button-cell battery sufficient to power a pipette 110 according to the invention for at least several months, though it will be recognized that rechargeable batteries and other battery form factors may also be employed, or the pipette 110 may be powered from an external source.

As illustrated, the position sensing transducer 414 includes two components: a sliding component 416 affixed to and moving with the piston plunger shaft 240, and a fixed component 418 affixed to the pipette body 112. Accordingly, then, the position sensing transducer 414 is able to detect and calculate the longitudinal displacement between the sliding component 416 and the fixed component 418. It will be recognized that there are numerous configurations of sensing components that can accomplish this function, including but not limited to a variable resistor (potentiometer), an optical sensor, a capacitive sensor, an inductive sensor, or a magnetic field sensor; these options are discussed in detail in U.S. patent application Ser. No. 11/906,180, incorporated by reference above. There are advantages to keeping the sliding component 416 passive and not directly energized, thereby eliminating the need to provide any electrical connection to the moving part, which might tend to bend, break, or otherwise fail over the course of time.

Figure 5:
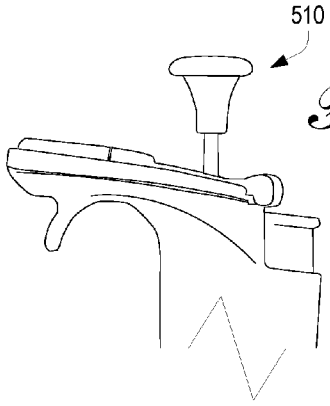
FIG. 5 is a schematic view illustrating a portion of the pipette of FIG. 3 with a plunger assembly in a released position against an upper stop.
Figure 6:
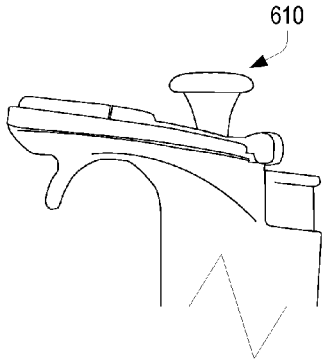
FIG. 6 is a schematic view illustrating a portion of a pipette of FIG. 3 with a plunger assembly in a partially-depressed home position.

As in traditional manual pipettes, the plunger button 114 (FIG. 1) is spring-biased relative to two positions, namely a released and extended position 510 shown in FIG. 5, and a home position 610 shown in FIG. 6. With no pressure applied to the plunger button 114, a plunger spring 420 (FIG. 4) biases the plunger button 114 upward against an upper volume-setting stop, the position of which is adjusted by turning the plunger button 114 and a stop position adjustment mechanism as discussed above. In this position, the piston plunger shaft 240 and plunger button 114 are at the released and extended position 510 with respect to the body 112 of the pipette 110 as graphically illustrated in FIG. 5.

Figure 7:
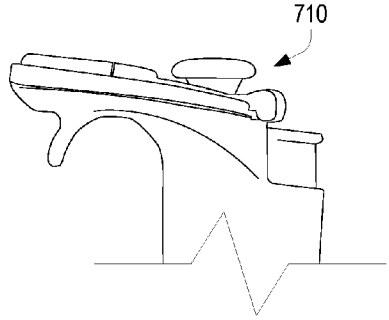
FIG. 7 is a schematic view illustrating a portion of a pipette of FIG. 3 with a plunger assembly in a fully-depressed blow-out position.

At the fixed home position 610 illustrated in FIG. 6, with the plunger button 114 partially depressed, the resistance to depression of the plunger button increases. As is common in handheld pipette construction, a secondary blowout spring adds to the resistance offered by the plunger spring 418. The increased resistance is sensed by the pipette user and defines the home position 610. Between the released and extended position 510 and the home position 610, only the plunger spring 420 biases the plunger button position upward toward its extended position 510, and a relatively light first force level is required to act against the spring bias. Between the home position 610 and a fully-depressed blowout position 710 illustrated in FIG. 7, both the plunger spring 420 and the blowout spring act upward against the plunger button 114, and a higher second force level is required to act against the spring bias. This configuration including a primary plunger spring 420 and a secondary blowout spring is common in handheld pipettes.

Accordingly, at the home position 610, the user feels a tactile transition between the two spring forces, and by exerting a force between the first level and the higher second level, the user can easily keep the plunger button at the home position. As will be discussed in further detail below, the ability of the user to identify and maintain the piston 412 at the home position 610 is a requirement for certain desirable pipetting operations.

Figure 8:
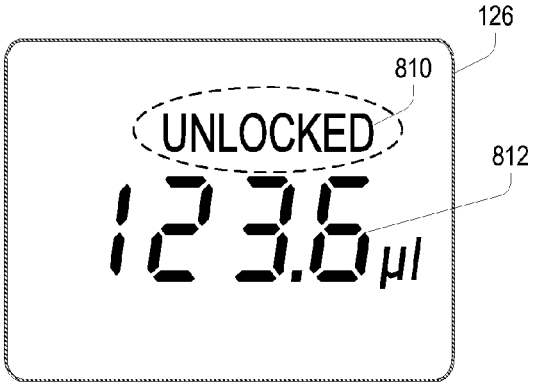
FIG. 8 is a view of a user interface display in a quick-set pipette according to the invention with a volume setting lock in an unlocked condition.
Figure 9:
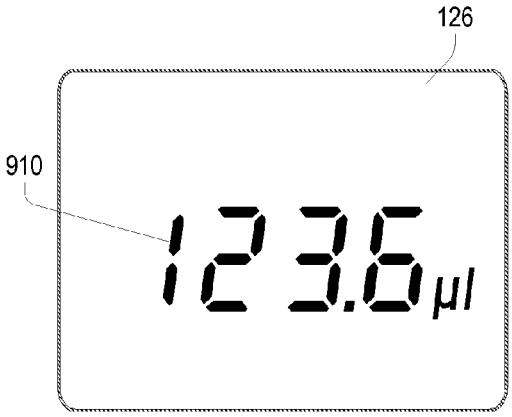
FIG. 9 is a view of a user interface display in a quick-set pipette according to the invention with a capacity set to an exemplary value of 123.6 microleters.
Figure 10:
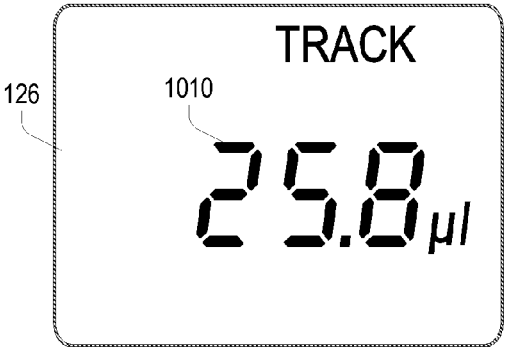
FIG. 10 is a view of a user interface display a user interface display in a quick-set pipette according to the invention in a tracking mode with the pipette piston in a position representing an exemplary value of 25.8 microleters of capacity.

FIGS. 8-10 set forth illustrative aspects of the user interface display 126 of one embodiment of a quick-set pipette 110 (FIG. 1) according to the invention, when such a user interface display is present.

Initially, and as shown in FIG. 8, the user slides the volume set lock lever 244 (FIG. 2) to an unlocked position 246 to allow the pipette 110 to be adjusted. The volume set lock lever 244 is equipped with a lock state switch that indicates the state of the lock to a processing unit contained in the pipette 110. In an embodiment of the invention, the processing unit comprises a low-power microcontroller capable of running on a small battery for long periods of time, and further capable of operation in a very-low-power "sleep" state while the pipette 110 is not being used. The MSP430 series of ultra-low-power microcontrollers from Texas Instruments Inc. includes integrated circuits that meet these needs, many of which further provide additional digital and mixed-signal system-on-a-chip functionality that can be advantageously employed in a quick-set pipette 110 according to the invention; other vendors also have products that might easily be substituted.

In certain operating modes, while the volume set lock lever 244 is in its unlocked position 246, the display 126 displays a flashing "UNLOCKED" indication 810 and the currently set volume of the pipette 812, which in the illustration is 123.6 microleters. By turning the plunger button 114, sequentially actuating coarse volume adjustment and fine volume adjustment mechanisms as described below (with reference to FIGS. 11-14), the user can adjust the position of the upper volume-setting stop as in traditional pipettes. However, because the plunger button 114 is spring-biased to its extended position 510 against the adjusted upper volume-setting stop, the display 126 will be updated with the position of the piston 412 as it moves with the stop. In any event, any volume reading obtained while adjusting the volume of the pipette 110 can only be considered accurate if no longitudinal pressure is being applied to the plunger button 114.

When the user locks the volume setting by sliding the volume set lock lever 244 to the locked position 248, a lock state switch actuates, causing the "UNLOCKED" indication to disappear from the display 126 and as illustrated in FIG. 9 the display 126 displays the fixed volume setting 910 regardless of the position of the piston 412. The display 126 is decoupled from the real-time position of the piston 412, allowing the user to determine the capacity of the pipette at a glance, regardless of what stage of pipetting the user is engaged in. Of course, it will be observed that the processing unit still receives measurements of the position of the piston 412; they are simply not being displayed.

When the volume set lock lever is actuated, an accurate and precise measurement is taken of the position of the piston 412 and calibrated by the processing unit as set forth in greater detail below. Because of the tight coupling among the plunger button 114, the sliding component 416 of the position sensing transducer 414, and the air displacement piston 412, and further because of the capability of the position sensing transducer 414 to accurately and precisely read the position of the piston, and of the processing unit to adjust that observed position and apply both linear and non-linear compensation, calibration, and adjustment functions as necessary, this volume reading is considered more precise and more accurate than is generally possible using a manual pipette with a mechanical rotary position readout. In particular, the electronic display is not subject to slack or backlash; further advantages will be detailed below.

In a tracking mode, with the volume set lock lever 244 is in its unlocked position 246 (FIG. 2), the display 126 shows the real-time position of the piston 412 in terms of volume (as in FIG. 8), with zero being at the home position 610 and the maximum capacity of the pipette being at the fully-released position 510 of the plunger button 114. But as set forth in FIG. 10, with the volume set lock lever 244 in its locked position 248 (FIG. 2), the display 126 continues to show the real-time position of the piston 412 in terms of volume 1010. If the user wishes, the volume of liquid in the tip 116 at any time can be determined by reading a value on the display.

Many other operating modes and display features are possible in a quick-set pipette according to the invention, and are described in detail in U.S. Pat. No. 7,175,813, which is hereby incorporated by reference as though set forth in full herein.

Figure 11:
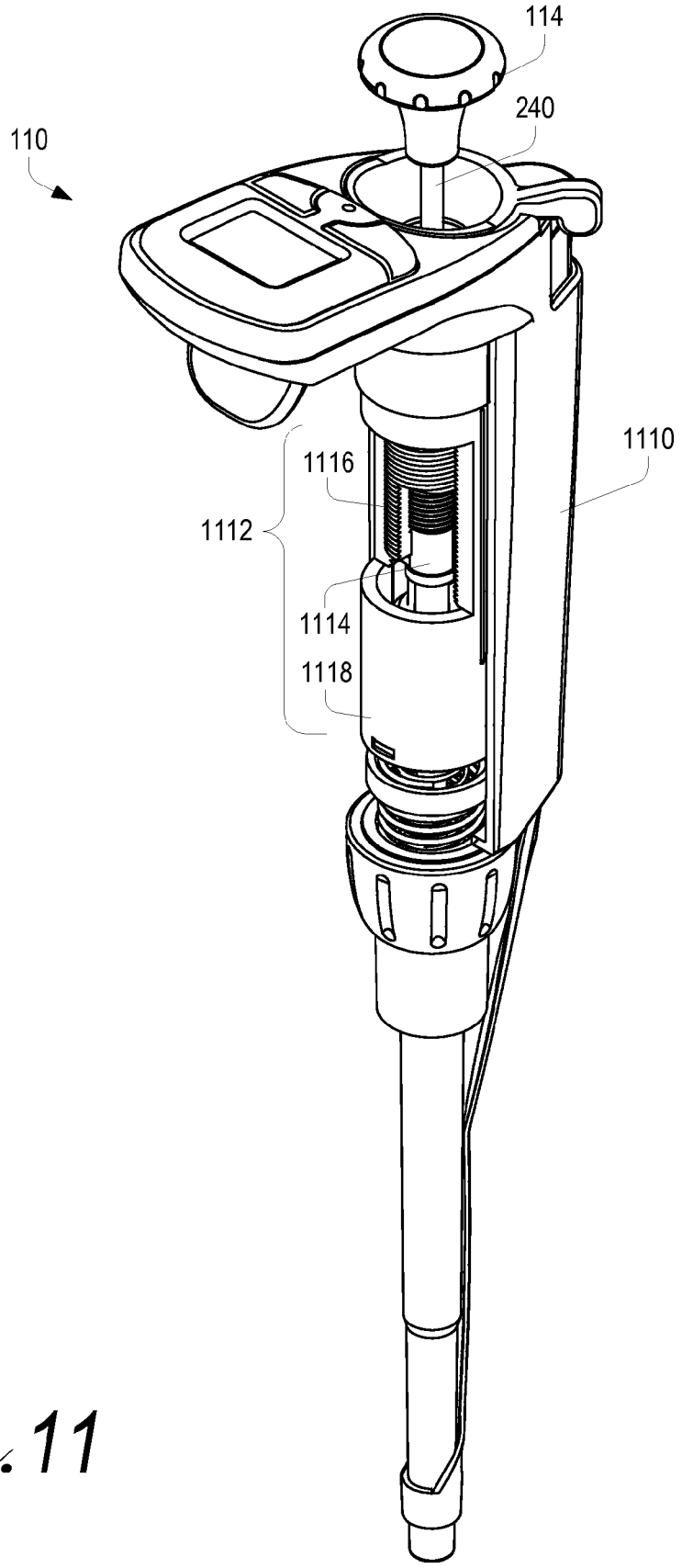
FIG. 11 is a cutaway view of a volume adjustment mechanism in a quick-set pipette according to the invention.

The volume adjustment mechanism is described below, with particular reference to FIGS. 11-14. The overall volume adjustment mechanism is illustrated in FIG. 11.

Basically, the quick set volume adjustment mechanism comprises a volume setting upper stop, internal to the quick-set pipette 110, for limiting upward axial movement of a plunger unit (comprising the plunger shaft 240 and the piston 412) in a housing 1110 to define the volume setting for the pipette 110. In the present invention, the volume setting upper stop preferably is supported for axial movement in the housing 1110 only in response to a user turning of a volume adjustment knob, which in the disclosed embodiment is the plunger button 114. In this regard, a turning of the volume adjustment knob activates operation of either a coarse volume setting means or a fine volume setting means, each of which is described in further detail below.

The coarse volume settings means is supported in the housing 1110 such that when activated, a relatively small turning of the volume adjustment knob produces a relatively large axial movement (i.e. coarse adjustment) of the volume setting upper stop. Similarly, the fine volume setting means is supported within the housing 1110 such that when activated, a relatively large turning of the volume adjustment knob produces a relatively small axial movement (i.e. fine adjustment) of the volume setting upper stop. Thus, by sequentially activating the coarse and fine volume setting means through a sequential turning of the volume adjustment knob, a user of the pipette of the present invention is able to quickly and accurately set and reset the volume of the pipette simply by turning the plunger button 114. In these regards, a sequential turning of the volume adjustment knob is defined as a turning of the volume adjustment knob which will sequentially activate the coarse and fine volume setting means described herein.

The volume adjustment mechanism 1112 comprises, in the disclosed embodiment, a nested arrangement of finely and coarsely threaded sleeves. Turning the volume adjustment knob (the plunger button 114 in the disclosed embodiment) preferentially turns a finely threaded inner sleeve 1114. The inner sleeve 1114 bears relatively fine external threads engaging with corresponding internal threads on an intermediate sleeve 1116. Accordingly, then, for fine volume adjustments, the inner sleeve 1114 is caused to rotate by turns of the volume adjustment knob, and the fine external threads of the inner sleeve translate rotation of the plunger shaft 240 to relatively small axial movements of the inner sleeve 1114, which is coupled to and axially moves the volume setting upper stop for the pipette 110. This rotation of the inner sleeve 1114 within the intermediate sleeve 1116 is only permitted over a short range of angular motion, as will be described in further structural detail below. In the embodiment described herein, the inner sleeve 1114 is free to rotate within the intermediate sleeve 1116 over a range of approximately only 180 degrees.

When the plunger shaft 240 is rotated further, the inner sleeve 1114 stops rotating within the intermediate sleeve 1116, and the inner and intermediate sleeves 1114 and 1116 rotate together within a fixed outer sleeve 1118. The fine external threads of the inner sleeve 1114 and the corresponding internal threads of the intermediate sleeve 1116 remain in a fixed relationship, and a set of relatively coarse external threads on the intermediate sleeve 1116 traverse corresponding coarse internal threads on the fixed outer sleeve 1118. Accordingly, with the inner sleeve 1114 and the intermediate sleeve 1116 locked together, the relatively coarse external threads of the intermediate sleeve will translate the turns of the volume adjustment knob into relatively large axial movements of both the intermediate sleeve 1116 and the inner sleeve 1114, and hence the volume setting upper stop.

Figure 12:
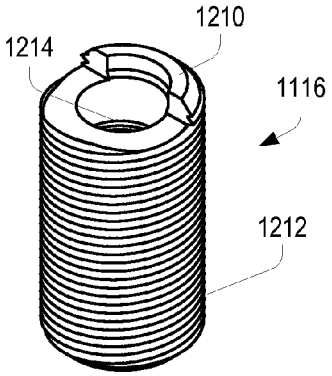
FIG. 12 is a view of an exemplary intermediate sleeve of a volume adjustment mechanism in a quick-set pipette according to the invention.
Figure 13:
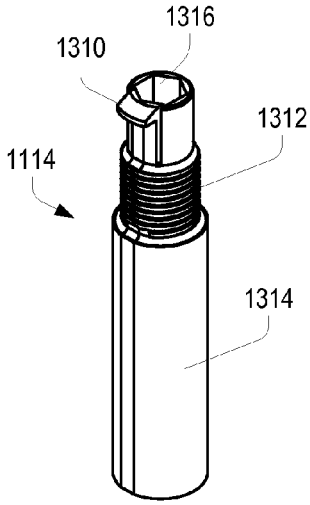
FIG. 13 is a view of an exemplary inner sleeve of a volume adjustment mechanism in a quick-set pipette according to the invention.
Figure 14:
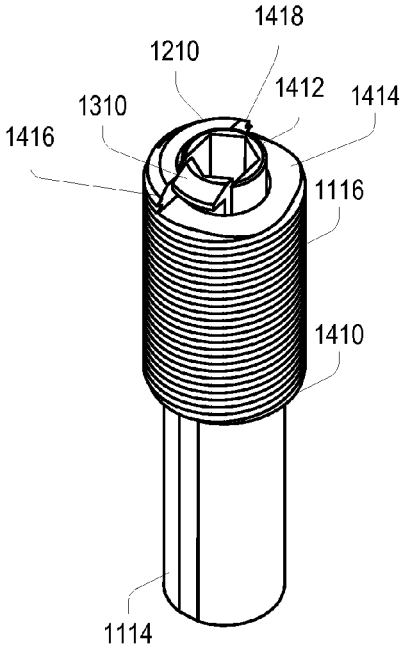
FIG. 14 is a view of an assembly comprising an intermediate sleeve and an inner sleeve of a volume adjustment mechanism in a quick-set pipette according to the invention.

The inner sleeve 1114 and the intermediate sleeve 1116 are illustrated in greater detail in FIGS. 12-14.

The intermediate sleeve 1116, shown in FIG. 12, is formed from a single integral molded or machined piece of polymer. In the disclosed embodiment, it is fabricated from an appropriate grade of polyester such as HYDEX® (A.L. Hyde Co.). The intermediate sleeve 1116 is generally cylindrical in shape, with a raised upper shoulder-shaped projection 1210 that serves to limit the rotation of the inner sleeve 1114 as described below. As described herein, the relatively coarse external thread 1212 is a four-start thread with a pitch of approximately 32 threads per inch. Accordingly, each revolution along the external thread 1212 traverses approximately ⅛ inch axially along the intermediate sleeve 1116. The relatively fine internal thread 1214 is a single-start thread with a pitch of approximately 32 threads per inch. Accordingly, while a traditional manual pipette using only a 32 thread per inch volume setting mechanism may require twenty full turns to adjust from zero to full capacity (0 to 100%), a quick-set pipette according to the invention would require only approximately five turns of the coarse volume setting means to move the volume setting mechanism over the same distance.

The inner sleeve 1114, shown in FIG. 13, is also an integral single molded or machined polymer piece. In the disclosed embodiment, it is fabricated from an appropriate grade of polyetherimide (PEI), such as ULTEM® (SABIC Innovative Plastics, formerly GE Plastics). The inner sleeve 1114 is generally cylindrical in shape, with a radially projecting limiter pin 1310. A portion of the inner sleeve 1114 bears an relatively fine external thread 1312, which as disclosed is a single-start thread with a pitch of approximately 32 threads per inch, to mate with the corresponding internal thread 1214 of the intermediate sleeve 1116. The inner sleeve 1114 further has an elongated body 1314, defining a hexagonal shaft-receiving channel 1316. A lower end of the elongated body 1314 either serves as or is coupled to the volume setting upper stop for the pipette 110. When assembled, the channel 1316 receives the plunger shaft 240 (which also has a hexagonal cross-section), permitting rotational movement of the shaft 240 to act also upon the inner sleeve 1114.

The fixed outer sleeve 1118 (FIG. 11) is fabricated, in the disclosed embodiment, from any suitable material, such as an appropriate grade of polyester (PET).

The inner sleeve 1114 and the intermediate sleeve 1116 are assembled as shown in FIG. 14. The limiter pin 1310 of the inner sleeve 1114 is somewhat flexible and deformable, and may be urged inward (into the channel 1316), allowing the external threads 1312 of the inner sleeve 1114 to be screwed into the internal threads 1214 of the intermediate sleeve 1116 starting at a lower end 1410 of the intermediate sleeve 1116. When the inner sleeve 1114 is fully screwed into the intermediate sleeve 1116, an upper end 1412 of the inner sleeve 1114 extends from an upper end 1414 of the intermediate sleeve 1116, and the limiter pin 1310 returns back to its normal unbiased position.

The initial rotational position of the inner sleeve 1114 relative to the intermediate sleeve 1116 will determine which of the coarse or fine volume setting means is initially operational. It will be seen in FIG. 14 that the limiter pin 1310 of the inner sleeve 1114 is resting against a first end 1416 of the projection 1210 of the intermediate sleeve 1116. Any attempt to rotate the shaft 240, and hence the inner sleeve 1114, clockwise (as viewed from the upper ends 1412 and 1414) will urge the limiter pin 1310 against the projection 1210, causing the intermediate sleeve 1116 to rotate along with the inner sleeve 1114 and the shaft 240. When the intermediate sleeve 1116 is mounted within the fixed outer sleeve 1118, the relatively coarse external threads 1212 of the intermediate sleeve 1116 will move with respect to the corresponding internal threads of the fixed outer sleeve 1118, and the volume adjustment mechanism 112 will move axially approximately ⅛ inch per rotation of the volume adjustment knob.

In contrast, rotating the shaft, and hence the inner sleeve 1114, counterclockwise from the position shown in FIG. 14 (as viewed from the upper ends 1412 and 1414) will allow the inner sleeve 1114 to rotate within the intermediate sleeve 1116, as the two sleeves are uncoupled. The relatively fine external threads 1312 of the inner sleeve 1114 will move with respect to the corresponding internal threads 1214 of the intermediate sleeve 1116, and the volume adjustment mechanism 1112 will move axially approximately 1/32 inch per rotation of the volume adjustment knob.

This condition will persist for approximately 180 degrees of counterclockwise rotation of the volume adjustment knob, at which time the limiter pin 1310 will contact a second end 1418 of the projection 1210 of the intermediate sleeve 116, thereafter coupling the inner sleeve 1114 and the intermediate sleeve 1116 together for further rotation, which will result (again) in approximately ⅛ inch of axial movement per rotation of the knob.

It will be apparent, then, that rotating the volume adjustment knob over a range of approximately 180 degrees will preferentially engage the fine volume setting means, while rotating it further (in either direction) will engage the coarse volume setting means. It is stated above that the fine volume setting means (i.e., the inner sleeve 1114) is preferentially moved within that 180-degree interval. This is accomplished by maintaining a relatively low coefficient of friction in the thread interface between the inner sleeve 1114 and the intermediate sleeve 1116, and a relatively higher coefficient of friction between the intermediate sleeve 1116 and the fixed outer sleeve 1118. This may be facilitated through precise part dimension tolerances and material choices, as will be apparent to an engineer having ordinary skill.

It will be recognized that the inner sleeve 1114 either acts as or cooperates with an axially movable structure that serves as the upper stop, described above, for plunger movement in a pipette according to the invention. Accordingly, a volume setting for the pipette 110 may be performed by repeated turning of the plunger button 114, which engages both the inner sleeve 1114 and the intermediate sleeve 1116 to accomplish a coarse volume setting. The plunger button 114 may then be backed off, reversing the direction of initial rotation, which disengages the intermediate sleeve 1116 and accomplishes a fine volume setting over a 180 degree interval. If more than 180 degree rotation is made at this stage, the coarse volume setting means is re-engaged.

As discussed above in connection with FIGS. 4 and 8-10, a position sensor is advantageously coupled to the plunger button 114, the plunger shaft 240, or the piston 412 (or some other component coupled thereto), allowing the pipette 110 to read the position of the piston 412 as desired. When the plunger button 114 is not depressed, the position of the piston 412 corresponds to the volume setting for the pipette 110. In an alternative embodiment of the invention, the position sensor may be coupled to the upper volume-setting stop, which may comprise a portion of the inner sleeve 1114 or a component coupled to the inner sleeve 1114.

A conventional volume lock mechanism (the operation of which is described with reference to FIG. 2, above) employs a cam-and-collet arrangement to fix the rotational position of the volume adjustment mechanism 111 2 within the housing 1110. Details of this arrangement are set forth in the '813 and '248 patents, incorporated by reference above.

It has been found, however, that at least in part as a result of the particularly steep thread angles in the coarse volume setting means, strong impacts to the plunger button 114 and other portions of the plunger mechanism of the pipette 110, even when the lock lever 244 is positioned to engage the lock apparatus, may result in undesired movements of the volume adjustment mechanism 1112.

A quick-set pipette 110 according to the invention therefore incorporates structures and features to minimize the possibility and consequences of such undesired movements of the volume adjustment mechanism 1112. In particular, it has been found that damping the axial movement of the plunger shaft 240 by applying a frictional or viscous damping influence to that structure will tend to avoid such abrupt movements by limiting the velocity of the plunger within the pipette 110. This has the effect of reducing the incidence of strong impacts of the plunger mechanism against the volume setting upper stop. Such strong impacts tend to dislodge the lock apparatus, and accordingly reducing the strength and incidence of impacts by the structures and methods set forth herein will also reduce unintended movements of the volume adjustment mechanism 1112.

Such damping influence may be applied by a structure (such as a friction pad) mechanically interfering with the axial movement of the plunger shaft 240, or by fluid damping. An air dashpot mechanism for damping plunger movement is disclosed in U.S. Pat. No. 5,364,596, which is hereby incorporated by reference as though set forth in full. Such a dashpot mechanism may be advantageously employed in a pipette according to the invention. However, in the disclosed embodiment, damping is accomplished in a simple and economical manner by applying a viscous fluid between a component that is axially fixable relative to the housing 1110 and a component coupled to the axially moving plunger shaft 240.

In the disclosed embodiment, a fluoroether or silicone grease, such as KRYTOX® grease (DuPont), is applied between the plunger shaft 240 and the hexagonal shaft receiving channel 1316 of the inner sleeve 1114. When the locking apparatus is in the locked configuration, the axial position of the inner sleeve 1114 is fixed relative to the housing 1110. Alternatively, such a grease may be applied to a narrow gap between the sliding component 416 and the fixed component 418 of the position sensing transducer 414. Other locations within the pipette 110 may also be suitable.

The grease is selected to be sufficiently viscous in all operating temperatures and conditions to avoid substantial migration out of the desired location, for the duration of the operating life of the pipette. The grease should not be overly viscous, however, to avoid adversely impacting the operation and "feel" of the pipette when relatively quick piston movements are desired. Greases meeting these criteria are well known. In alternative embodiments of the inventive pipette 110, the grease may be applied between the sliding component 416 and the fixed component 418 of the position sensing transducer 414, or at any other suitable location where there exists relative axial motion between the components.

In practice, the damped action of the plunger shaft 240 reduces the effect of accidental and otherwise undesired impacts upon the volume adjustment mechanism 111 2, without substantially compromising the operation of the pipette in other ways. With such damping in place, the volume lock mechanism has been found to be secure and reliable, comparable in practice to traditional pipettes without the quick-set volume adjustment capability described herein.

It should be observed that while the foregoing detailed description of various embodiments of the present invention is set forth in some detail, the invention is not limited to those details and a pipette made according to the invention can differ from the disclosed embodiments in numerous ways. In particular, it will be appreciated that embodiments of the present invention may be employed in many different fluid-handling applications. It should be noted that functional distinctions are made above for purposes of explanation and clarity; structural distinctions in a system or method according to the invention may not be drawn along the same boundaries. Hence, the appropriate scope hereof is deemed to be in accordance with the claims as set forth below.

What is claimed is:

1. A volume adjustable pipette, comprising:

a housing;

a plunger mounted for axial movement in the housing to and from a stop during aspiration of a fluid into and dispensing of the fluid from a tip extending from the housing;

an axially moveable volume setting member in the housing defining the stop for the plunger and a volume setting for the pipette;

volume adjusting means for axially moving the volume setting member in response to a turning of a volume adjusting member;

a lock mechanism for selectively locking the position of the volume setting member;

fine and coarse volume setting means respectively responsive to relatively large and small turnings of the volume adjusting member for sequentially moving the volume setting member relatively small and large axial distances, respectfully; and a viscous interface for limiting the strength and incidence of impacts between the plunger and the volume setting member when the plunger is axially moved, wherein the viscous interface is located between either the housing or an axially fixable component and either the plunger or a component coupled to the plunger;

wherein the viscous interface is configured for damping plunger movement in response to an impact or a release of the plunger; and wherein the viscous interface is sufficiently viscous to prevent undesired movement of the volume setting member in response to the impact or release, without substantially adversely affecting the operation of the pipette.

2. The pipette of claim 1 further comprising means coupling the coarse and fine volume setting means for sequential operation.

3. The pipette of claim 2 wherein one of the coarse or fine volume setting means is characterized by a force threshold for movement of the volume setting member by the one of the coarse or fine volume setting means which is exceeded by a predetermined movement of the other of the coarse or fine volume setting means by the volume adjusting member.

4. The pipette of claim 1 further including means for monitoring the position of the plunger within the housing.

5. The pipette of claim 1 further including means for monitoring the position of the volume setting member within the housing.

6. The pipette of claim 1 wherein the viscous interface comprises a layer of grease.

7. The pipette of claim 1 wherein the axially fixable component comprises a sleeve.

8. The pipette of claim 1 wherein the axially fixable component is selectively movable while performing a volume setting adjustment and fixed while performing a pipetting operation.

9. The pipette of claim 1 wherein the viscous interface is between the axially fixable component and the component coupled to the plunger, and wherein the component coupled to the plunger comprises a sliding component of a position sensing transducer and the axially fixable component comprises a fixed component of the position sensing transducer.

10. The pipette of claim 1 further comprising:

means supporting the volume setting member for axial movement within the housing in response to a turning of the volume adjusting member wherein the means supporting the volume setting member for axial movement is responsive to a sequential turning of the volume adjusting member to produce a fine adjustment and a coarse adjustment of the volume setting for the pipette.

11. The pipette of claim 10 wherein:

the coarse volume setting means includes a relatively coarse thread on an axially extending screw carried by the volume setting member; and the fine volume setting means comprises a relatively fine thread on a sleeve comprising the volume adjusting member and which engages a relatively fine thread on the screw.

12. The pipette of claim 11 further comprising:

a fine adjustment limiter on a one of the volume adjusting member or screw; and a projection on another of the volume adjusting member or screw for engaging the limiter whereby a turning of the volume adjustment member with the limiter against the projection produces a turning of the screw with the volume adjusting member.

13. The pipette of claim 3 further comprising means supporting the volume setting member for axial movement within the housing in response to a sequential turning of the volume adjusting member independent of and with the volume setting member to respectively produce a fine adjustment and a coarse adjustment of the volume setting for the pipette.

14. The pipette of claim 13 wherein:

the coarse volume setting means includes a relatively coarse thread on an axially extending screw on the volume setting member; and the fine volume setting means comprises a relatively fine thread on a sleeve comprising the volume adjusting member and which engages a relatively fine thread on the volume setting member.

15. The pipette of claim 14 further comprising:

a fine adjustment limiter on a one of the volume adjusting member or volume setting member; and a projection on another of the volume adjusting member or volume setting member for engaging the limiter whereby a turning of the volume adjustment member with the limiter against the projection produces a turning of the volume setting member with the volume adjusting member.

* * * * *